US007843770B2

(12) United States Patent
Orme

(10) Patent No.: US 7,843,770 B2
(45) Date of Patent: Nov. 30, 2010

(54) INTERVAL TIMER

(76) Inventor: Robert L. Orme, 12055 S. Milona Dr., Draper, UT (US) 84020

( * ) Notice: Subject to any disclaimer, the term of this patent is extended or adjusted under 35 U.S.C. 154(b) by 107 days.

(21) Appl. No.: 12/291,587

(22) Filed: Nov. 12, 2008

(65) Prior Publication Data

US 2010/0118659 A1 May 13, 2010

(51) Int. Cl.
*G04F 10/00* (2006.01)

(52) U.S. Cl. ..... 368/109; 368/89

(58) Field of Classification Search ..... 368/89, 368/97–123

See application file for complete search history.

(56) References Cited

U.S. PATENT DOCUMENTS 3,759,032 A * 9/1973 Bassett et al. ..... 368/108
3,930,359 A * 1/1976 Flumm et al. ..... 200/38 FA
4,451,158 A * 5/1984 Selwyn et al. ..... 368/63
4,995,018 A * 2/1991 Edwards ..... 368/107
5,583,832 A * 12/1996 DePonty ..... 368/10
5,854,774 A * 12/1998 Timme ..... 368/10
6,326,883 B1 * 12/2001 Whitehead et al. ..... 340/309.8
6,547,434 B1 * 4/2003 DeRosa ..... 368/89
6,795,375 B2 * 9/2004 Streja ..... 368/10
7,317,664 B2 * 1/2008 Klein ..... 368/107
7,465,085 B2 * 12/2008 McDonough ..... 368/98
7,502,281 B2 * 3/2009 Rund ..... 368/82
2006/0133215 A1 * 6/2006 Gordon et al. ..... 368/79

* cited by examiner

*Primary Examiner*—Vit W Miska
*Assistant Examiner*—Sean Kayes
(74) *Attorney, Agent, or Firm*—David J. Wilson

(57) ABSTRACT

The present invention is directed towards a device and method of use for ensuring that persons who need to stay on a schedule can do so without constantly looking at a clock. The device is a programmable electronic device wherein the user can set a schedule time, an interval time and a sub-interval time and wherein the device alerts the user when one or more of these times are reached.

10 Claims, 3 Drawing Sheets

INTERVAL TIMER

BACKGROUND OF INVENTION

For some people (for example, professionals) keeping on schedule is important for the benefit of their clients and employees. For example, doctors often have a finite time to spend with each patient. Running over by only a few minutes with each patient can add up to hours by the end of the day's appointments. This causes patients to be seen late, may make them late for other appointments or work, etc. The person's employees will need to be paid overtime and they can not schedule things as simple as meeting a family member at an appointed time if they never know what time they will be leaving work. This problem is not unique to doctors. Any person that need to be kept on schedule (performers, mechanics, consultants, etc.) may run the risk of "going over" the allotted time.

Often times these persons may look at their watch or a clock if they have one available but this is not always a suitable solution. Some persons cannot remember to keep track of time and in other instances constantly looking at ones watch may send the wrong message to a patient, client or audience.

Therefore, what is needed is a device and method of use for reminding a professional person the time or keep the person on a schedule without being obvious to other persons that are near or watching.

SUMMARY OF INVENTION

In one aspect, the invention relates to a device designed to remind persons the time or keep the person on a schedule without being obvious to nearby persons or persons that are watching. In this regard, the present invention relates to a device that can be programmed to remind a person of the passage of time at predefined, programmable intervals. The device is small enough to be carried in a pocket, worn on a belt or worn on the wrist, for example. The device is electronic and battery powered. The device works by sending a signal to the wearer at predetermined intervals. For example, if an appointment is fifteen minutes long the user may program the device to send a signal every three or every five minutes. The signal may be audible or tactual (e.g., cause a vibration that can be felt by the user). The device, in one embodiment, would send a first signal at the first time point by, for example, making one audible sound or causing one vibration. At the second preset time point the device would send two signals. At the third preset time point the device would send three signals, etc. The device may alternatively play different sounds or emit vibrations of differing intensity or length to alert the user of the time at the different time points. In the context of the present invention this is defined as a "user diffentiatable alert" or a "user diffentiatable signal" and means that the user can differentiate the differences between the alerts or signals. In another embodiment, the user could turn the sound off or mute the sound with a switch and turn the sound back on again when desired.

At the end of the appointment (i.e., after the last signal) the device could be reset manually by, for example, pushing a reset button, or automatically wherein the device would start another cycle. Because of the periodic nature of the signals, the user would have a frequently reminder of the time left in the appointment For longer events, such as a performance, the timer could be set for longer intervals. In this way, if a performer was scheduled to give a 45 minute performance (such as for a warm-up performance before the main act) they could, for example, set the schedule time for 45 minutes, the interval time unit for 15 minutes and the sub-interval time unit for 5 minutes.

Thus, the user would set the a time for the total length of time, herein called the schedule time, a second time for the interval of time into which the scheduled time would be divided—herein called the interval time and wherein each unit of interval time would be called an interval time unit. The user could then set a third time into which the last interval time unit could be divided—herein called the sub-interval time and wherein each unit of sub-interval time would be called a sub-interval time unit. The sub-interval time is set only in the last interval time unit.

The device, in one embodiment, would also comprise a "stop" button to halt the count down of the schedule time (and also, by default, the interval time and sub-interval time). Upon pressing "stop" again the device would continue to count down form the point where it left off.

The device, as discussed above, would also comprise a clip or other means for attaching the device to, for example, clothing (shirt or pants pocket, belt or the like) or strap on, for example, a brief case, pocket book, backpack or guitar (or other musical instrument). In this regard, the device would be made such that when attached to, for example a belt, the controls would be easily viewable by the user. Also in this regard, the device may have a movable or reposition-able clip or securing means so that the user can easily reposition the device for easy viewing if the device is moved from one position to another (e.g., from the belt to a carry strap). For example, the device may be able to rotate on the clip so that the controls can be viewed over a range of, for example, 90 degrees.

In one embodiment, the interval time units may be set in predetermined units that are evenly divisible into the scheduled time and the sub-interval time units may be set in predetermined units that are evenly divisible into the last interval time unit.

In one embodiment, the device uses absolute time, wherein "real time" is defined herein as time that is based on the standard time or daylight savings time of the locale. In other words, for example, the user can set the schedule time to start "on the hour" or at any other time of his choosing. In still other words, "real time," as defined herein, is the time on the clock.

In another embodiment, the device uses relative time. "Relative time" as defined herein, is not based on or related to standard time or daylight savings time of the locale. In other words, for example, the user would set the scheduled time (e.g., fifteen minutes) independently of what ever "real time" it may be. "Relative time," as used herein, is time that is relative to the user's activities and not the time on the clock. Thus, the user can hit the "on" button, "start" or "reset" button on the device of the present invention to start the device measuring the scheduled time without having to correlating the device to any clock or having to set the scheduled time in relation to any clock. In this regard, in certain embodiment of the present invention, the device expressly does not comprise a clock.

In this regard, the present invention is directed towards a device and method of use for ensuring that persons who need to stay on a schedule can do so without constantly looking at a clock. The device is a programmable electronic device wherein the user can set a schedule time, an interval time and a sub-interval time and wherein the device alerts the user when one or more of these times are reached.

Other features and advantages of the invention will be apparent from the following description.

BRIEF DESCRIPTION OF DRAWINGS

FIG. 4 shows a top view of one embodiment of the present invention with an LCD screen, useful, for example, to review or monitor settings or time left in an interval or subinterval time, and the like.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

Figure 1:
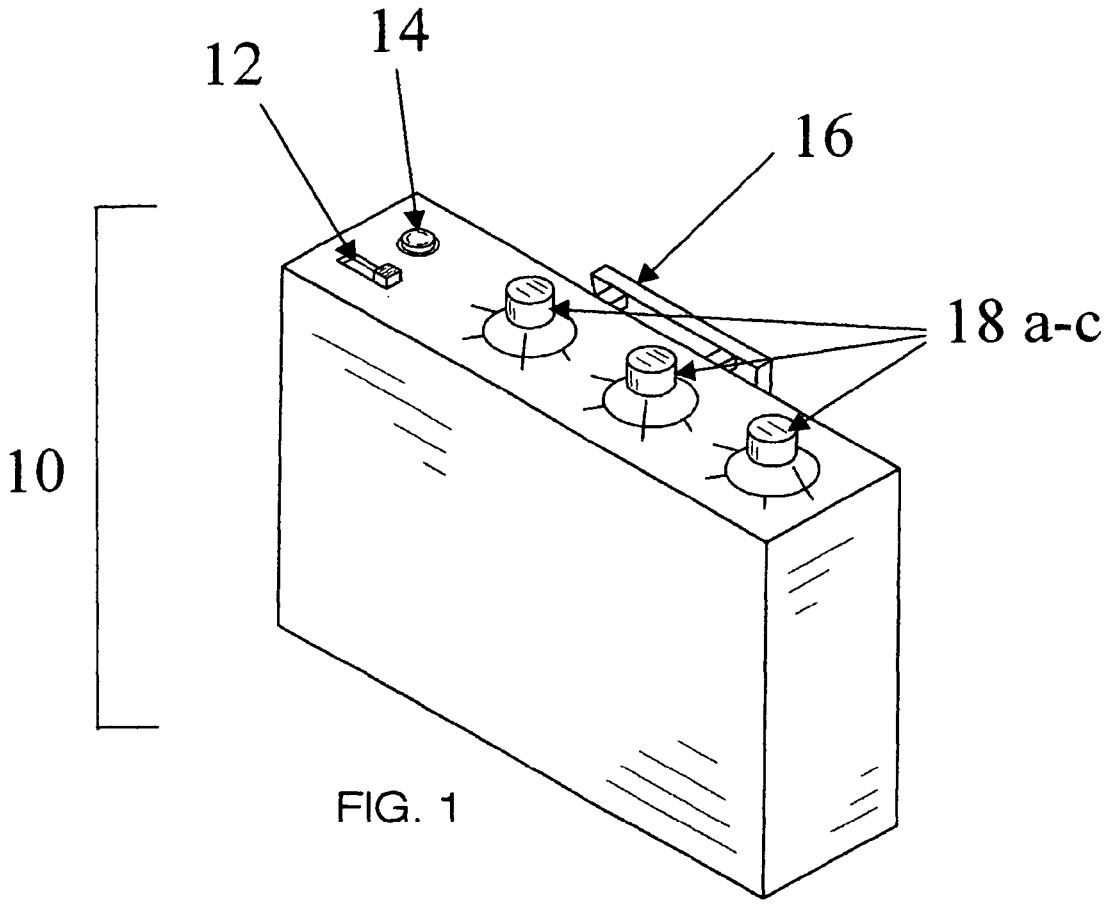
FIG. 1 shows a perspective view of one embodiment of the device of the present invention.

FIG. 1 shows a perspective view of one embodiment of the device present invention (10). This view shows the on/off switch (12), the reset button (14), a means for attaching the device to a belt or other item (16) and control or timer knobs (18*a-c*).

Figure 2:
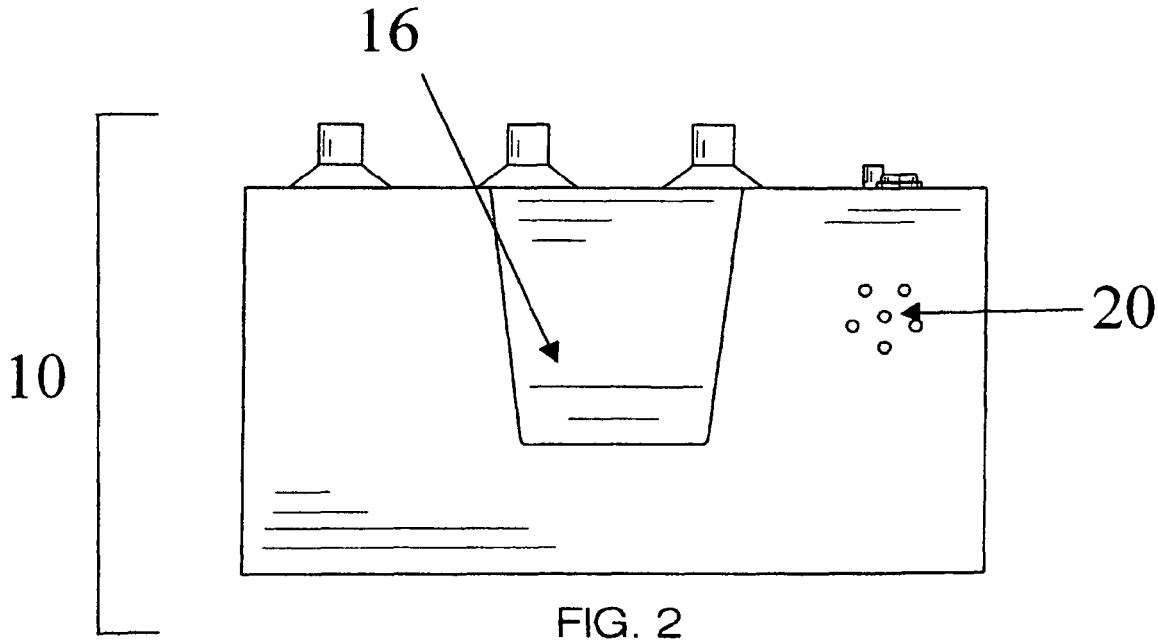
FIG. 2 shows a side view of one view of the device of the present invention.

FIG. 2 shows a side view of one embodiment of the device of the present invention (10). In this view the attachment means (16) and speaker grill (20) are visible.

Figure 3:
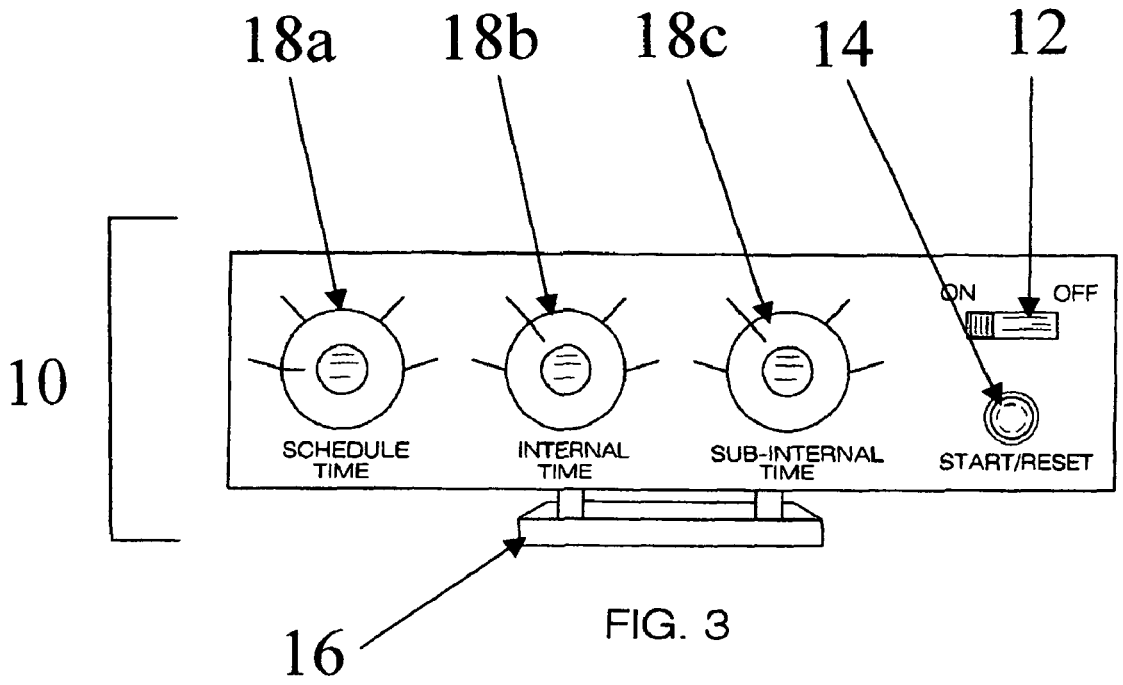
FIG. 3 shows a tip view of one embodiment of the present invention. In this view knobs are shown but other embodiments are contemplated that would re[place one or more of the knobs with sliders or buttons.

FIG. 3 shows a top view of one embodiment of the device of the present invention (10). Shown in this view are the on/off switch (12), the start/reset button (14), the means for attachment (16) the schedule time knob (18*a*), the interval time knob (18*b*) and the sub-interval time knob (18*c*).

Figure 4:
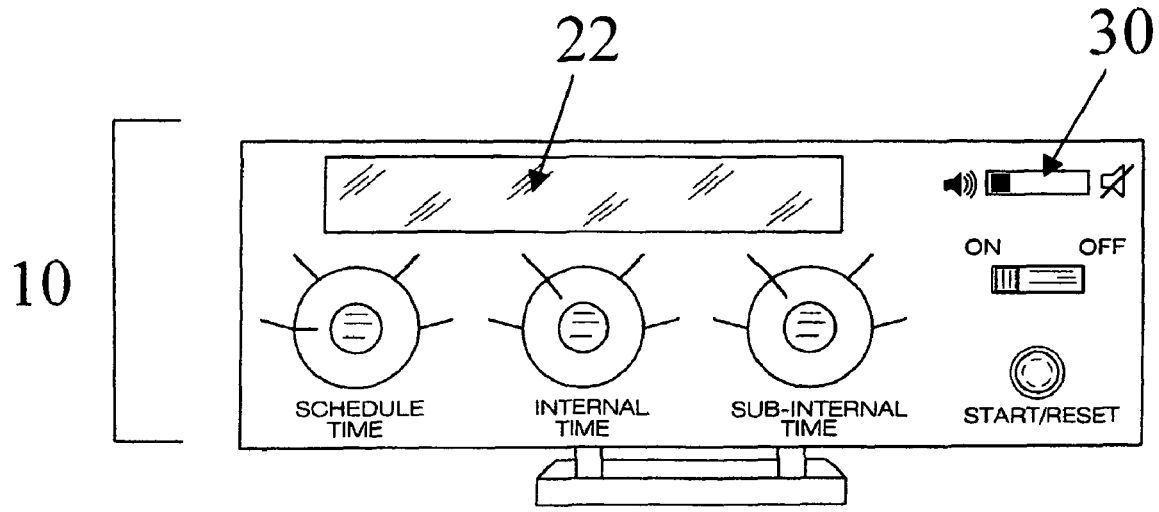

FIG. 4 shows an alternative embodiment of the top of the device of the present invention (10) wherein an LCD screen (22) is visible. Also visible is a switch for muting the sound (30).

Figure 5:
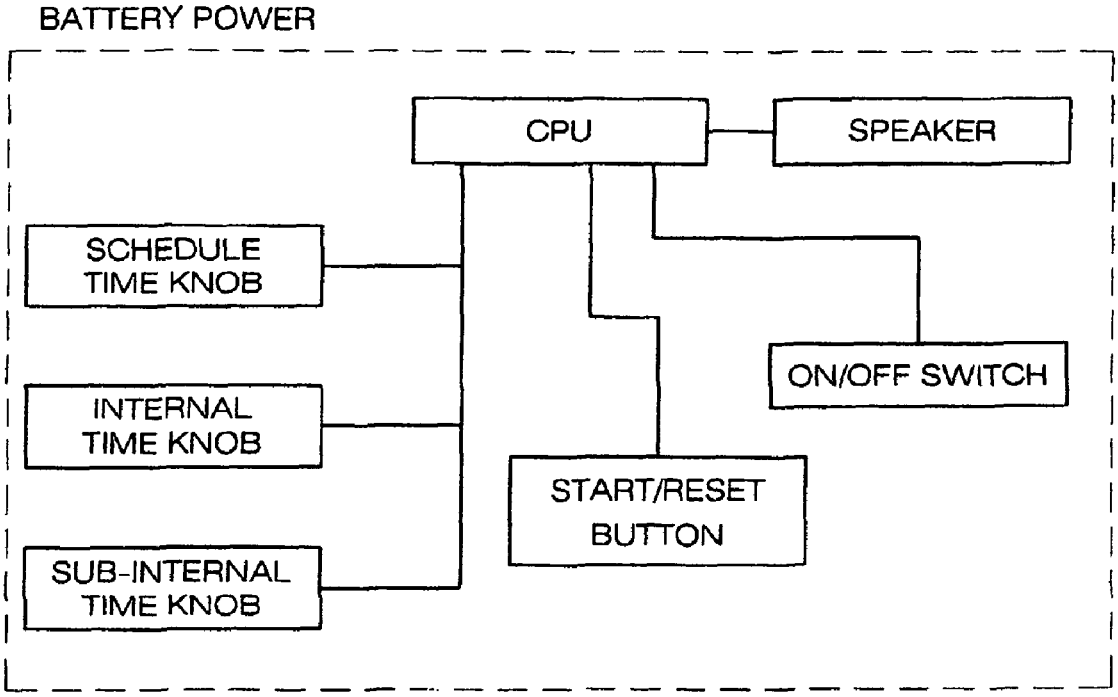
FIG. 5 shows a schematic diagram of one embodiment of the device of the present invention.

FIG. 5 shows a schematic diagram of one embodiment of the device of the present invention.

What is claimed is:

1. A programmable electronic device comprising:

a timer and a user interface;

the user interface consists:

a first control for setting a schedule time, a second control for setting an interval time, wherein said interval time is evenly divisible into said scheduled time creating multiple interval time units, a third control for setting a sub-interval time, wherein said sub-interval time is evenly divisible into a single interval time unit creating multiple sub-interval time units and wherein said sub-interval time is only settable in the last interval time unit, a fourth control for turning the device on and off, a fifth control for resetting or starting a count down of the scheduled time, and means for alerting the user that the end of the scheduled time or the end of an interval time unit or sub-interval time unit has been reached.

2. The programmable electronic device of claim 1, wherein said schedule time ranges from 5 minutes to 60 minutes.

3. The programmable electronic device of claim 2, wherein said schedule times are selected from the group consisting of 5, 10, 15, 20, 30, 45 and 60 minutes.

4. The programmable electronic device of claim 1, wherein said interval time units range for 1 minute to 15 minutes.

5. The programmable electronic device of claim 2, wherein said interval time units are selected from the group consisting of 1, 3, 5, 10 and 15 minutes.

6. The programmable electronic device of claim 1, wherein said sub-interval time units range for 0 minutes to 5 minutes.

7. The programmable electronic device of claim 6, wherein said sub-interval times are selected from the group consisting of 1, 3 and 5 minutes.

8. The programmable electronic device of claim 1, wherein said device further comprises a means for attachment to another object.

9. The programmable electronic device of claim 1, wherein said means for alerting the user is selected from the group consisting of sound and vibrations.

10. The programmable electronic device of claim 1, wherein said means for alerting the user generates a user diffentiatable alert for the end of each sub-interval time unit, interval time unit or schedule time.

* * * * *